United States Patent [19]

Roof

[11] Patent Number: 4,542,935

[45] Date of Patent: Sep. 24, 1985

[54] RECLINING CHAIR

[76] Inventor: James L. Roof, 2110 Leaphart Rd., West Columbia, S.C. 29169

[21] Appl. No.: 374,948

[22] Filed: May 5, 1982

[51] Int. Cl.[4] ..... A47C 1/034; A63G 9/00

[52] U.S. Cl. ..... 297/82; 297/81; 297/279

[58] Field of Search ..... 297/278, 279, 245, 273, 297/77, 80–82; 5/124, 125

[56] References Cited

U.S. PATENT DOCUMENTS 295,946 4/1884 Robinius ..... 297/81
383,206 5/1888 Bastian ..... 297/273 X
505,832 10/1893 King ..... 297/81 X
1,240,089 9/1917 Pottinger ..... 297/81

*Primary Examiner*—William E. Lyddane
*Assistant Examiner*—Peter R. Brown
*Attorney, Agent, or Firm*—Mills & Coats

[57] ABSTRACT

This invention is a reclining chair which includes a seat portion with a back portion and a leg portion pivotably connected thereto. An arm rest pivotably interconnects the back portion with a leg portion with suspension points being provided at both the back and leg portions. The rotation relationship between leg and back portions at their respective pivots to the seat portion is approximately two to one.

6 Claims, 3 Drawing Figures

RECLINING CHAIR

FIELD OF INVENTION

This invention relates to reclining means and more particularly to reclining chairs.

BACKGROUND OF INVENTION

Since man first began building seats, he has been concerned with the comfort of the same. Various styles, shapes and configurations have been utilized to achieve the desired comfort and utility but these fixed configurations have the disadvantage of not being adaptable to the varying needs of the user thereof. To overcome this inadequacy, various mechanical devices and contraptions have been developed and many more experimented with. These include everything from separate ottomans to chaise lounges to "Lazy Boy" type folding leg rests.

All of these prior known seating systems have either not had the versatility and universal movement required to give a broad range of comfort settings or have been so expensive that they are out of the price range of the average person or both.

BRIEF DESCRIPTION OF INVENTION

After much research and study into the above-mentioned problems, the present invention has been developed to provide a reclining chair which gives a broad range of comfort settings with an infinite number of adjustments being possible within the range boundaries. This reclining chair is relatively inexpensive to construct and yet is sturdy in structure, includes interconnected pivotable back and leg rest portions which, when manipulated, also change the disposition of the seat portion relative to the ground. Very little effort is required to change from one position to another and the entire range of adjustment can be traversed very quickly and readily.

In view of the above, it is an object of the present invention to provide an improved reclining chair which is inexpensive to build and yet is strong in structure.

Another object of the present invention is to provide a reclining chair which is readily adjustable with a minimum of effort.

Another object of the present invention is to provide a reclining chair having a foot rest portion interconnected with a back rest portion.

Another object of the present invention is to provide a reclining chair wherein the movement of leg rest compared to back rest relative to the seat portion is approximately two to one.

Another object of the present invention is to provide a reclining seat which can be supported from any number of various means.

Another object of the present invention is to provide a reclining chair which is supported solely from its leg support and back support portions.

Other objects and advantages of the present invention will become apparent from a study of the following description and the accompanying drawings which are merely illustrative of the present invention.

DETAILED DESCRIPTION OF INVENTION

Figure 1:
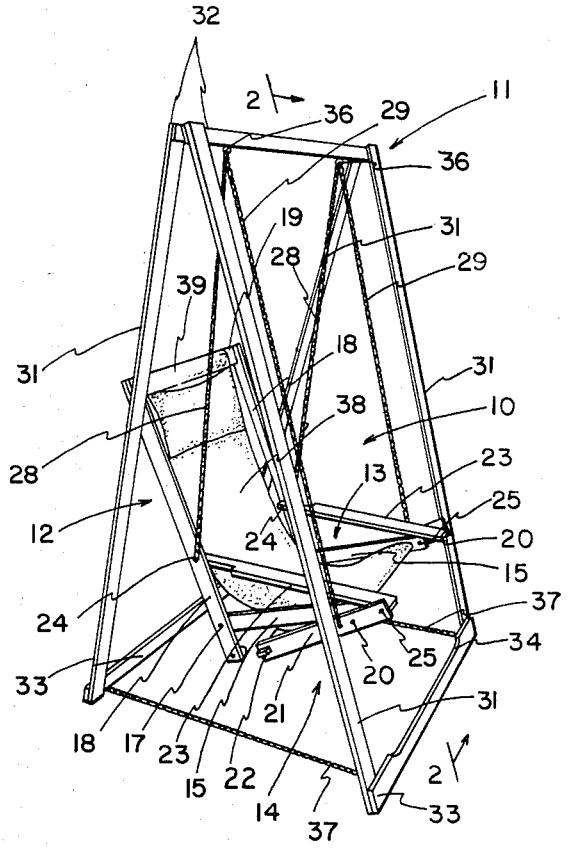
FIG. 1 is a perspective view of the reclining chair of the present invention suspended from one type of support frame and being disposed in a chair or sitting position.

With further reference to the drawings, the reclining chair of the present invention, indicated generally at 10, is shown with a typical support means, indicated generally at 11.

The reclining chair 10 of the present invention is composed of three basic parts, namely, a back portion indicated generally at 12, a seat portion indicated generally at 13, and a leg rest portion indicated generally at 14.

The central or seat portion 13 of the reclining chair 10 of the present invention includes two generally parallely disposed seat frame members 15 which are interconnected by leg support cross member 16. The connection of the seat frames 15 to opposite ends of cross member 16 can be by any standard method. Since connections of this type are well known to those skilled in the art, further detailed description thereof is not deemed necessary.

Presuming that cross member 16 is at the front of the seat portion 13 of reclining chair 10, then back portion 12 is connected to the rear of seat frames 15 by pivot pins 17. These pivot pins also pass through the lower portion of generally parallely disposed back rest frame members 18 to form a hinged joint between such frame members and their respective seat frames 15 as can clearly be seen in the drawings.

At the end of back rest frame members 18 opposite pivot pin 17 is a back rest cross member 19 interconnecting such frame members. A slot connection is shown in the drawings and has been found very satisfactory. Since connections of this type are well known to those skilled in the art, further detailed discussion of the same is not deemed necessary.

Just forward of the connection between seat cross member 16 and seat frame members 15 is a pivot means such as pivot pin 20. These pivot pins 20 pivotably connect said seat frame members 15 to generally parallely disposed leg rest frame members 21 to form a pivotable connection between seat portion 13 and leg rest portion 14 as can clearly be seen in the Figures.

A leg rest cross member 22 is provided at the outer extremity of leg rest frame members 21 and interconnects the same in a manner similar to cross member 19 connecting frame members 18.

Figure 2:
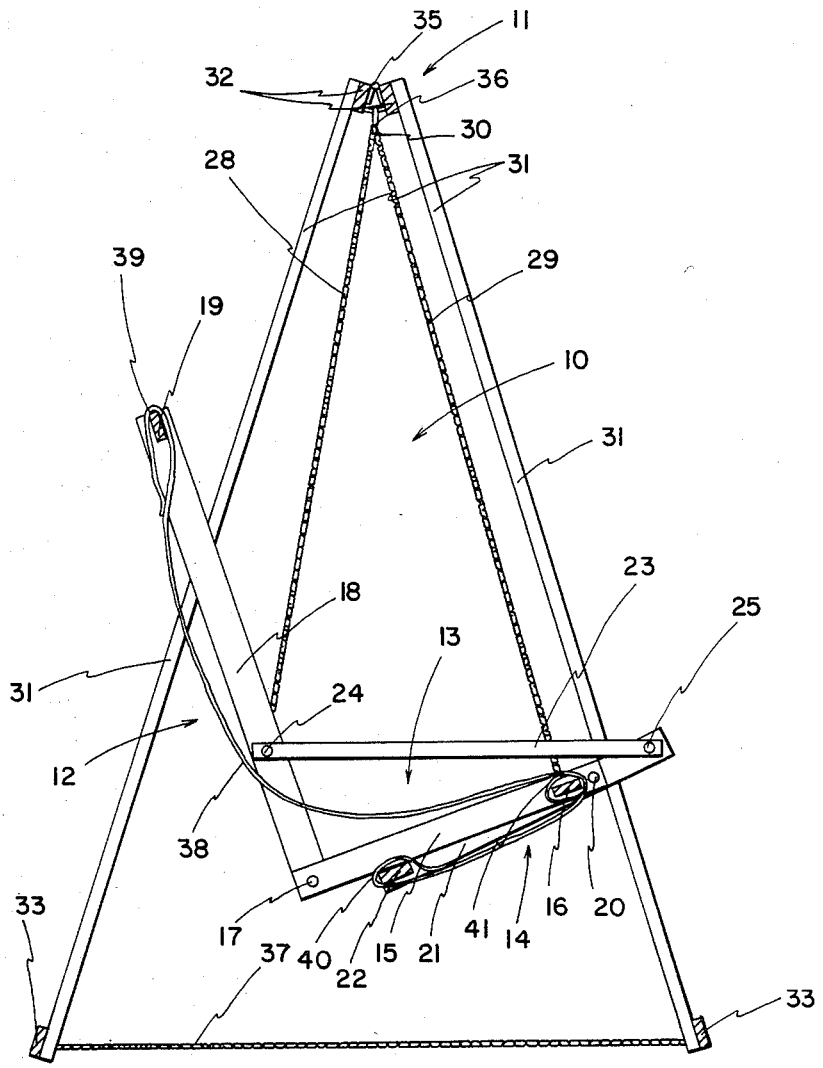
FIG. 2 a sectional view taken through lines 2—2 of FIG. 1.
Figure 3:
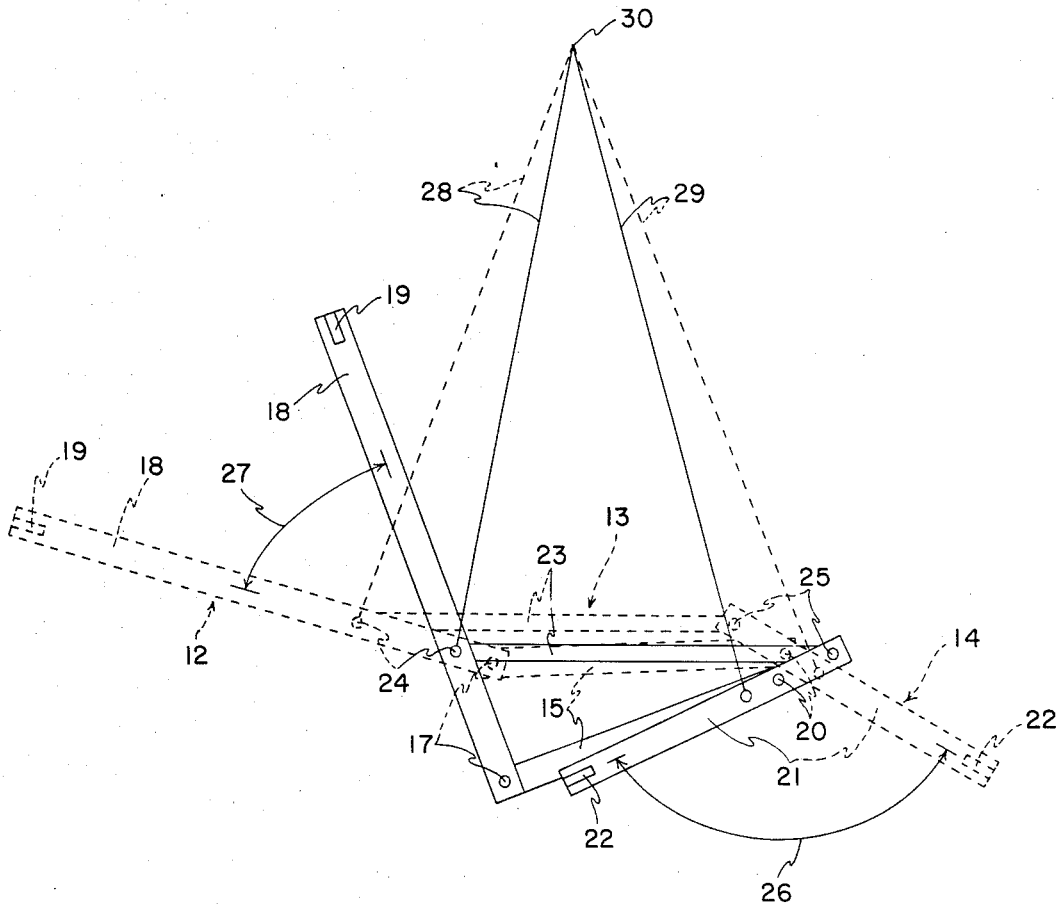
FIG. 3 is a schematic view of the chair of the present invention in reclined position.

An arm rest 23 interconnects each of the paired back rest frame members 18 and leg rest frame members 21 as can clearly be seen in FIGS. 2 and 3. The rear end of each of the arm rests 23 is pivotably mounted by means such as pivot pin 24 to its respective frame member 18 intermediate such frame members pivot pin 17 and cross member 19.

The opposite or front end of each of the arm rests 23 is pivotably mounted by means such as pivot pin 25 to the outer end of respective leg rest frame members 21 opposite leg rest cross member 22, again as clearly seen in FIG. 3.

The relative distances between pivot pins 17 and 24 along frame members 18, between pivot pins 17 and 20 along seat frame members 15, the distance between pivot pins 20 and 25 along leg rest frame members 21, and the length of arm rest 23 are all so proportioned that leg rest pivot angle 26 and back rest pivot angle 27 are at an approximate two to one ratio. In other words, if leg rest pivot angle 26 is 130 degrees, then back rest pivot angle 27 would be 65 degrees which is shown in FIG. 3. This two to one ratio of pivot or rotation between the leg rest and hack rest portions should at all times be maintained although variations from the 130 degree/65 degree figures can be used. Through extensive experimentation, it has been found that maximum pivot ratio of 150 degrees/75 degrees and minimum pivot ratio of 110 degrees/55 degrees leg rest to back rest should be maintained for optimum comfort.

To support the reclining chair 10 of the present invention, suspension means such as chains, ropes, wires, rods, or the like or a combination thereof can be used.

Two suspension means are used, the first of these suspension means, indicated at 28, is secured at one end to each of the back rest frames 18 at respective arm rest pivots 24. The second support means 29 on each side of the reclining chair 10 has one end connected to leg rest frame 21 between pivot 20 and cross member 22 but much closer to said pivot as can clearly be seen in FIGS. 1 and 3.

Although the support or suspension means 28 and 29 do not necessarily have to converge to a single support point as indicated at 30 in FIG. 3, when such suspension means do so converge, the reclining chair 10 can be readily manipulated as a swing, whether in the upright or reclined position. It is to be understood, however, that the configuration of this support or suspension means is not necessary for appropriate operation of the present invention.

It should also be noted that although a swing type support means has been shown in FIGS. 1 and 2, glider type supports, ceiling supports, outdoor tree limb supports or other means could just as well be used with the reclining chair 10 of the present invention and still have it function basically as hereinabove described.

Although the support means 11 as indicated above is not intended to be limiting to the present invention but is considered exemplary only, we will now refer to the same in greater detail.

The example support means 11 is composed of front and back support frames each including generally parallely disposed upright members 31, a top cross member 32 and a bottom cross member 33 fixedly connected thereto. The front bottom cross member 33 has a cutout area 34 so that it will not interfere with use of the reclining chair 10. The two top cross members 32 are hingedly connected as indicated at 35 so that the support means 11 can be folded for storage. Support connectors 36 are used to connect support means 28 and 29 to the hingedly connected, parallely disposed top cross members 32. Finally chains or other suitable means 37 are used to interconnect bottom cross members 33 to provide a stable, inverted V-frame shaped support means as shown in FIG. 1 for the reclining chair 10 of the present invention.

The end 39 of support fabric 38 of chair 10 is looped over and thus is supported by cross member 19 of back rest portion 12. The opposite end of fabric 38 is looped around and thus supported by leg rest cross member 22 as indicated at 40. Where support fabric 38 passes over cross member 16, a pocket is formed as indicated at 41 to stabilize such support fabric relative to the various parts of the reclining chair of the present inven- tion.

Due to specific relationship of the various pivot points to the various frame and arm rest members, once a user of the reclining chair 10 of the present invention has sat in the same while in the configuration shown in FIGS. 1 and 2 and in solid lines in FIG. 3, he can simply swing back and forth or if he wishes to recline he simply pushes backward against cross member 16 of seat portion 13 to cause the chair 10 to recline to the position shown in dotted lines in FIG. 3. If a suspension means for the chair is somewhat similar to that indicated generally at 11, then the user of the chair 10 can continue to swing back and forth if he desires while in the reclined position.

Because of the counterbalanced pivot and connecting arrangement disclosed, chair 10 of the present invention readily moves from reclined to non-reclined position and to any one of an infinite number of intermediate positions therebetween without having to maintain constant restraining or holding pressure.

Adjustable friction means can be used at one or more of the sets of pivot points if desired to allow for fine tuning of the easily adjustable reclining portion of the present invention while allowing any chosen position to be more firmly maintained.

From the above it can be seen that the present invention provides a relatively inexpensive and yet highly efficient reclining chair type means which between defined limits has an infinite number of adjustments. Because of the arrangement of the pivot and suspension points, an almost effortless reclining means is provided which is very relaxing to use, is strong in structure, and can give the user thereof years of pleasant service.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A reclining chair comprising: a seat portion having a bottom, a front area and a rear area; a back rest poriton pivotably connected to the rear area of said seat portion and movable from a generally upright position to a downward reclined position; a leg rest portion pivotably connected at a point intermediate its ends to the front area of said seat portion and movable from a tucked position underneath the bottom of said seat portion to an extended position where the leg rest portion extends outwardly from the front area of said seat portion; arm rest means pivotably said back rest portion and to one end of said leg rest portion and operative to move said back rest portion from said generally upright position to said downward reclined position in response to said leg rest portion being moved from said tucked position to said extended position and first and second support means, said first support means connected to said back rest portion and said second support means connected to said leg rest portion with said second support means being connected to said leg rest portion at a point thereon between the other end of said leg rest portion and the pivotal connection of said leg rest portion and said seat portion; and wherein the seat portion, back rest portion, leg rest portion, and arm rest means are so proportioned that the angle of pivot of said leg rest portion as compared to said back rest portion is a ratio of approximately two to one, whereby a comfortable, easily adjustable reclining chair is provided wherein the leg rest portion is pivoted up against the bottom of the seat portion when the back rest portion is in maximum upright position and is outwardly extending from said seat protion when said back rest portion is reclined.

2. The reclining chair of claim 1 wherein the maximum ratio of pivot angles is approximately 150 degrees to 75 degrees.

3. The reclining chair of claim 1 wherein the minimum ratio of pivot angles is approximately 110 degrees to 55 degrees.

4. The reclining chair of claim 1 wherein the ratio of pivot angles is in the range from 150 degrees/75 to 110 degrees/55 degrees.

5. The reclining chair of claim 1 wherein an elongated fabric supports the body of the user of the chair.

6. The reclining chair of claim 1 wherein said support means is collapsible for more ready transport and storage.

* * * * *